United States Patent [19]

Hasegawa

[11] Patent Number: 4,608,799

[45] Date of Patent: Sep. 2, 1986

[54] BUILDING BLOCK SYSTEM

[76] Inventor: Stanley Hasegawa, 868 Yuba St., Richmond, Calif. 94805

[21] Appl. No.: 766,243

[22] Filed: Aug. 16, 1985

Related U.S. Application Data

[63] Continuation-in-part of Ser. No. 687,865, Dec. 31, 1984.

[51] Int. Cl.[4] ..... E04B 1/48; A63H 33/10

[52] U.S. Cl. ..... 52/582; 52/127.7; 52/584; 52/585; 446/112; 446/113; 446/488

[58] Field of Search ..... 52/582, 584, 585, 127.7; 446/488, 112, 113

[56] References Cited

U.S. PATENT DOCUMENTS

| | | | |
|---|---|---|---|
| 184,589 | 11/1876 | Childs | 52/585 X |
| 958,557 | 5/1910 | Stiggleman | 52/584 |
| 1,000,395 | 8/1911 | Frost | 52/585 X |
| 1,146,223 | 7/1915 | Wiswell | 52/584 X |
| 2,156,155 | 4/1939 | Howard | 52/648 X |
| 2,862,254 | 12/1958 | Meek | 52/582 X |
| 3,288,158 | 1/1966 | Russell | 52/584 X |
| 3,581,431 | 6/1971 | Trenovan | 446/488 |
| 3,665,669 | 5/1972 | Huber | 52/594 |
| 3,702,520 | 11/1972 | Huber et al. | 52/594 X |
| 4,334,683 | 6/1982 | Campbell | 446/488 X |

FOREIGN PATENT DOCUMENTS

| | | | |
|---|---|---|---|
| 518725 | 4/1953 | Belgium | 446/113 |
| 2901245 | 7/1980 | Fed. Rep. of Germany | 446/112 |
| 178591 | of 1922 | United Kingdom | 52/584 |

*Primary Examiner*—Alfred C. Perham
*Attorney, Agent, or Firm*—Alvin E. Hendricson

[57] ABSTRACT

Hollow blocks formed of corrugated cardboard, for example, have top edge openings receiving inverted U-shaped connectors for joining successive blocks together in a row or course and end slots together with top center slots receiving T-shaped connectors that include locking means for joining stacked rows or courses together.

9 Claims, 15 Drawing Figures

BUILDING BLOCK SYSTEM

This is a continuation-in-part of U.S. patent application Ser. No. 687,865 12/31/84 entitled Building Block System.

BACKGROUND OF INVENTION

There have been developed innumerable different toy building blocks, beams, panels and the like with joinder means of varying complexity for children to simulate building all types of constructed units. Reference is made, for example, to U.S. Pat. Nos. 1,000,395, 2,156,155 and 3,581,431. Such toys are generally intended for "table top" use to form small scale replicas of adult bridges, towers, buildings and the like and many incorporate some type of snap-on connection or interlocking parts for joinder of elements. The famous "Erector Set" of the thirties employed bolts and nuts to join perforated beams to form a myriad of different structures.

The present invention provides a lightweight building block system that may be employed by children to build enclosures large enough for entry by the child and yet strong enough to withstand being played with and on by children.

SUMMARY OF THE INVENTION

The present invention provides building blocks that may be formed, for example, of folded corrugated cardboard so as to have a substantial structural strength, and which are preferrably provided in a size commensurate with conventional bricks. Such blocks, or bricks are hollow and may include an interior "egg crate" structure to further enhance the structural strength thereof. A particularly advantageous configuration is herein illustrated and described herein. Corrugated plastic may also be used to form the blocks for use in the outdoors.

In addition to the blocks hereof, there are provided connectors formed of plastic, for example, and adapted to cooperate with the blocks through particularly located openings or slots therein to attach adjacent blocks together in longitudinal courses and stacked courses. These elements are adapted to form walls, as of a building or the like, and in addition specially adapted members provide for "roofing" buildings so formed, if desired.

Not only does the present invention provide for the construction of walls and the like but also for locking blocks of a course or row together and locking together successive rows or courses. Inverted U-shaped connectors attach adjacent blocks in a row while locking same together and spacing same apart the slight distance necessary to accommodate substantially T-shaped connectors joining adjacent blocks to a block of a lower course or row. Additionally, a resiliently deflectable locking member may be provided for insertion through a side opening in a block of a course to engage the leg of each T-shaped connector to prevent retraction of such connector and thus to firmly lock successive courses together. Alternately the T-shaped connector is provided wth a lateral extension at the bottom of the leg thereof for locking such connector in place.

BRIEF DESCRIPTION OF DRAWINGS

The present invention is illustrated with respect to particular preferred embodiment thereof in the accompanying drawings, wherein.

DESCRIPTION OF PREFERRED EMBODIMENT

Figure 8:
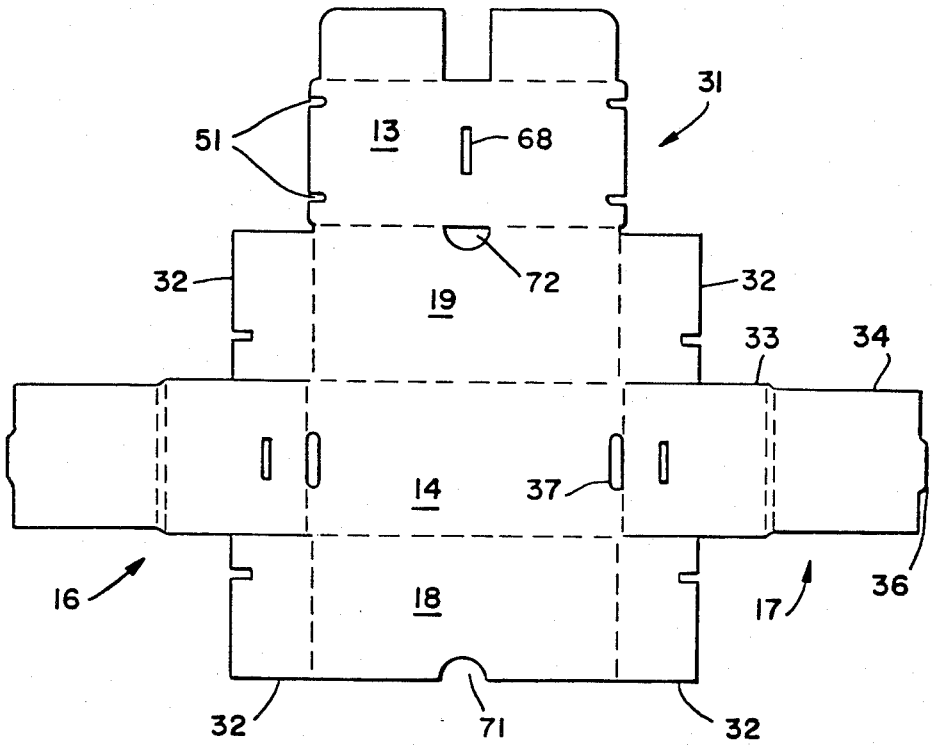
FIG. 8 a plan view of a blank from which a block in accordance herewith may be formed by folding along fold lines shown thereon.

The system of the present invention comprise a plurality of blocks 12 which may be, for example, be formed of folded corrugated cardboard in a closed rectangular shape with each block having a top and bottom 13 and 14, ends 16 and 17 and front and back sides 18 and 19. Various manners of folding cardboard or the like to form enclosures are known in the art and thus the blocks of the present invention are not limited to any particular folding system. As an example, there is illustrated in FIG. 8 a blank 31 from which a block may be folded. Fold lines are indicated as dashed lines in FIG. 8, and it will be seen that the front and back panels 18 and 19 have end tabs 32 adapted to be folded over to form the interior of end walls 16 and 17. Double extensions 33 and 34 at each end of the bottom panel 14 are adapted to be folded up and then over and down about the folded tabs 32 with an end projection 36 on the outer most tab or extension 34 adapted to fit into a slot 37 in the bottom 14. Another example of a reinforced block is shown in FIGS. 9,10 and 13 through 15 of the drawings, and is further described below.

Figures 1, 2, 3, 4:
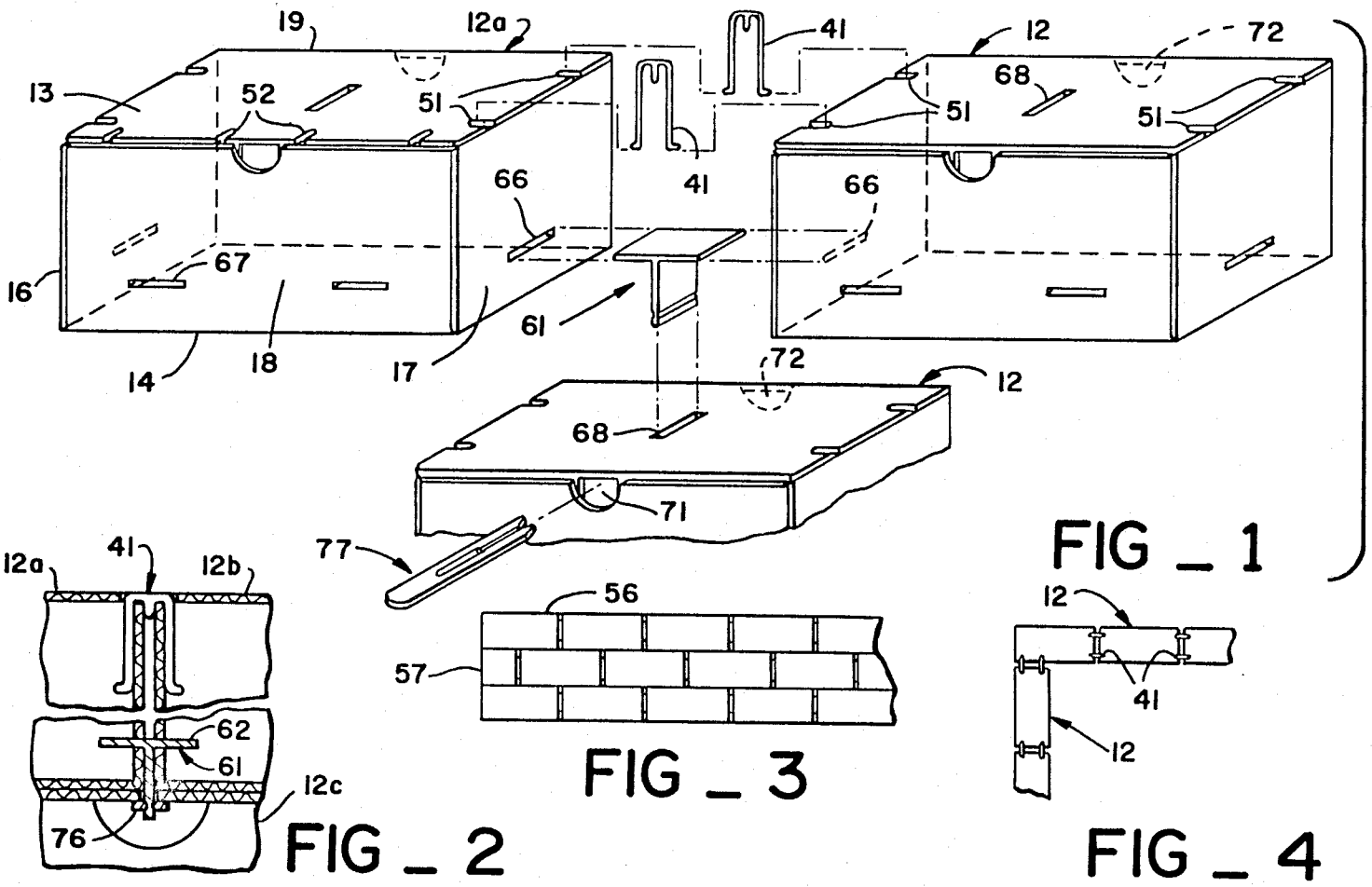
FIG. 1 is a schematic exploded perspective illustration of the system of the present invention.
FIG. 2 is a partial vertical sectional view through two adjacent blocks of a row and an underlying block of a contiguous row and showing the joinder thereof by the connectors of the present invention.
FIG. 3 is a side elevation of a low wall formed of the blocks thereof in accordance with the present invention.
FIG. 4 is a partial plan view of a wall corner in accordance herewith.
Figure 5:
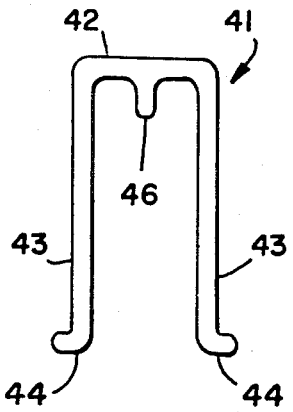
FIG. 5 is a plan view of an inverted U-shaped connector.

In addition to the blocks 12 the present invention includes connectors for joining the blocks together, and referring to FIG. 5, there will be seen to be illustrated an inverted U-shaped connector 41 having a top cross piece 42 with depending legs 43 with round turned out knobs or feet 44 thereon. A centered depending dimple or spacer 46 is provided at the center of the top cross piece 42 of the connector and having a predetermined width, as further discussed below. Each of the blocks 12 are provided with top edge openings 51, preferrably two on each end, as illustrated in FIG. 1. With two blocks 12*a* and 12*b* disposed in contiguous end to end relationship, the connector 41 is inserted in aligned openings 51 of the separate blocks by pressing the legs 43 downward through openings 51 to clamp the block together with a slight space between blocks, as determined by the width of the spacer 46 on the connector. Preferrably a pair of connectors are provided and inserted at each end block connection, again as generally indicated in FIG. 1. In this manner a course or row of blocks may be connected together and the out turned feet 44 on the connectors aid inserting same in the block openings. The legs 43 of the connectors are spaced apart a sufficient distance so that they may be inserted in the openings of adjacent blocks to clamp against the inner side ends of the blocks and thus hold the blocks firmly together. The blocks may also be joined by a single connector 41 at each end, however, it is preferable in this instance to provide the connector with a greater depth, normal to the illustration of FIG. 5, in order to assure stability of connection.

Figure 6:
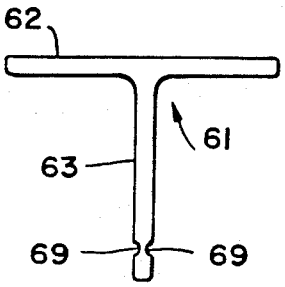
FIG. 6 is an end elevational view of a T-shaped connector.

There is also provided herein a means for connecting successive rows or courses of blocks stacked one upon the other to form a wall or the like, as indicated at 56 in FIG. 3. To this end there is provided a T-shaped connected 61 which is shown in FIG. 6 as having a flat top cross piece or plate 62 and a central depending plate 63. This connector is adapted to have the top cross piece 62 thereof fitted into end slots 66 in the ends 16 and 17 of the adjacent blocks of a course or row. The width of the depending plate 63 of the T-shaped connector 61 is equal to the width of the spacer 46 on the inverted U-shaped connector 41. The end openings 66 in the blocks are disposed adjacent to the bottom of the blocks so that the plate 63 of the connector 61 will depend or extend below the bottom 14 of each block and such connector may then be inserted in a top slot 68 at the center of a block 12 disposed below the blocks having the connector 61 inserted in the ends thereof.

Figure 7:
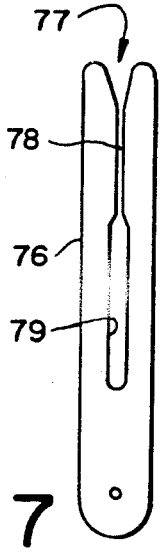
FIG. 7 is a plan view of a resilent locking means for the T-shaped connector of FIG. 6.

Provision is made for retaining connector 61 in engagement with a lower block 12*c* and to this end the depending plate 63 of the connector 61 may be provided with indentations or grooves 69 longitudinally thereof on opposite side of the plate adjacent the bottom thereof, as illustrated in FIG. 6. The T-shaped connector is dimensioned to fit into the top slot 68 of a lower block 12*c* with the groove 69 immediately below the top 13 of the block. Front and rear openings 71 and 72, provided in each block adjacent the top thereof and aligned with the slot 68, accommodate a resilient clamp or locking means 76 that may be inserted below the top from front to back or vice versa for engaging the plate 63 of the T-shaped connector 61 extending into the block. This locking means 76, as shown in FIG. 7, may take the form of a flat narrow plate formed of resiliently flexible plastic or the like having a V-shaped notch 77 at the leading end and terminating in a very narrow slot 78 extending longitudinally of the plate to a larger or an expanded slot 79 having a length substantially equal to the length of the depending plate 63 of the T-shaped connector 61.

The locking means 76 is employed by inserting same through an opening 71 in the block having the plate 63 of a T-shaped connector extending through the top slot 68. The locking means is then pressed onto the connector plate 63 at the groove 69 to slightly spread the locking means at the slit 78 as the locking means is slid over the plate until the blade is entirely disposed within the slot 79 in the locking means. The width of the slot 79 is made substantially the same as the width of connector plate 63 at the groove 69 therein and the slot 79 has the same length as this plate. In this manner the T-shaped connector will be seen to be locked in position engaging the lower block 12 and firmly retained between a pair of upper blocks, inasmuch as the inverted U-shaped connectors 41 prevent the upper blocks from moving apart to release the T-shaped connector. It will be, of course, be appreciated that the T-shaped connector is to be inserted into the upper row or course of block before the U-shaped connectors are employed to attach the blocks thereof together.

References is now made to FIG. 2, illustrating the connection of three blocks together. Upper blocks 12*a* and 12*b* are shown to have the top cross piece 62 of a T-shaped connector 61 extending through the end slots 66 of the block with the plate 63 depending from the bottom of these blocks. With a blocks 12*a* and 12*b* locked together by the inverted U-shaped 41 connector as illustrated, these block 12*a* and 12*b* are slightly spaced apart by the spacer 46 and the depending plate 63 of the T-shaped connector 61. This plate 63 will be seen to extend through the top slot 66 of the lower block 12*c*. The locking means 76 is shown to be in positioned in engagement with the bottom of the depending plate 63 of the connector 61 and engaging the under side of the top block 12*c*. This locking means 76 may be readily inserted through opening 71 in the lower block 12*c* and may be removed by pressing the locking means 76 off of the connector 61 through the rear opening 72 of the lower block. Preferrably the leading or forward end of the slot 79 in the locking means 76 is slanted as indicated in FIG. 7, in order to facilitate removal of the locking means from the connector.

Figure 12:
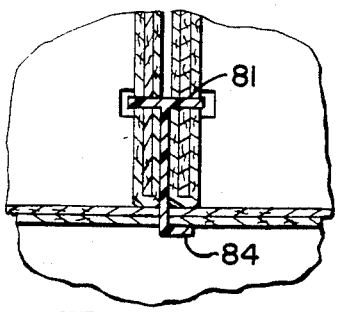
FIG. 12 is a partial sectional view like FIG. 2 and illustrating the joinder of blocks with the T-connector of FIG. 11.
Figure 11:
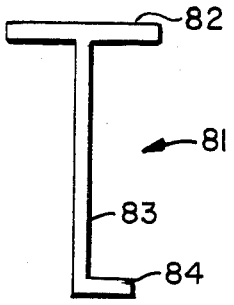
FIG. 11 is an elevational view of an alternative T-shaped connector.

The present invention also provides an alternative T-shaped connector 81 which is shown in FIGS. 11 and 12. This connector 81 also has a flat top cross piece 82 and a central depending plate 83, but includes a right angle bottom flange 84 for locking the connector to a block 12*c* of a lower course. This flange is located at the same place as one of the grooves 69 of the connector 61 so that in assembly, with the top piece 82 disposed in the end slots 66 of adjacent blocks 12*a* and 12*b*, the flange 84 will bear on the under surface of the top 13 of a lower course block 12*c*, as shown in FIG. 12. It is noted, however that courses of blocks are built up with the connector 81 from the bottom up by first inserting the flange 84 through the top slot 68 of lower block 12*c* and pivoting the connector into the postion of FIG. 12 and then applying the upper course blocks 12*a* and 12*b*, as shown. The connector 81 is then disposed in locking enagement between upper and lower courses of blocks and insertion of U-shaped connectors, as described above, holds blocks 12*a* and 12*b* together to complete the attachment of these blocks. Note that this arraignment does not require a separate locking member nor special openings for insertion and removal of same.

The building block of the present invention may be formed in a variety of ways, as noted above, and reference is made to FIGS. 9 and 10 for a preferred embodiment of the building block. This exploded view of FIG. 9 does not show the attachment openings and reference is made to FIGS. 13–15 for illustrations of the sheets from which the blocks is formed and including such openings.

Figure 9:
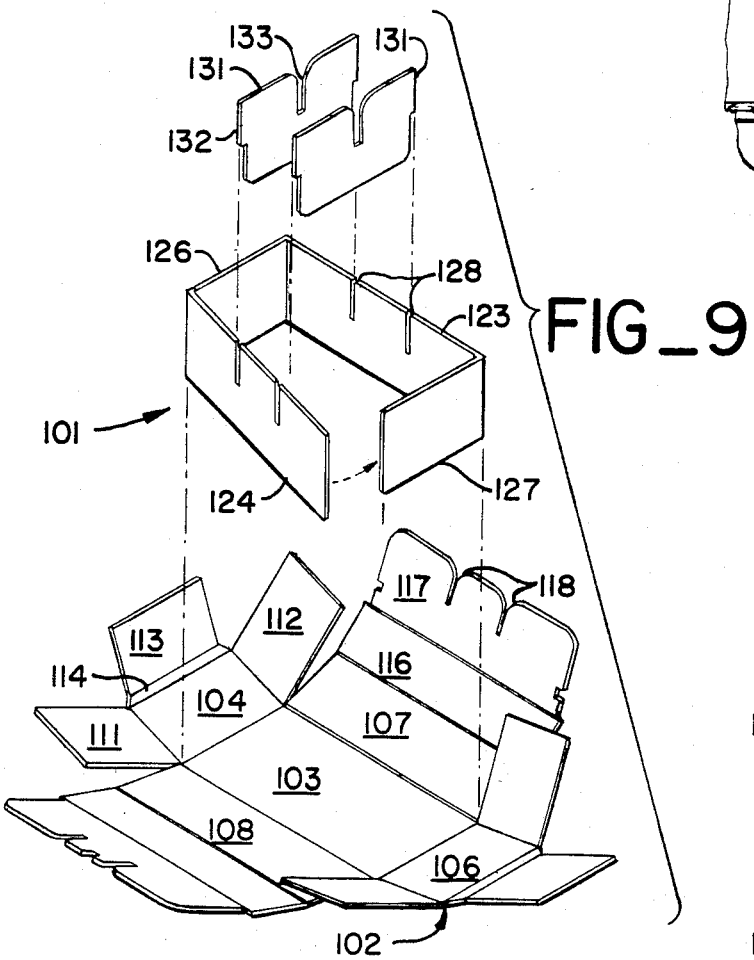
FIG. 9 is an exploded view of an alternative block structure in accordance with the present invention.
Figure 10:
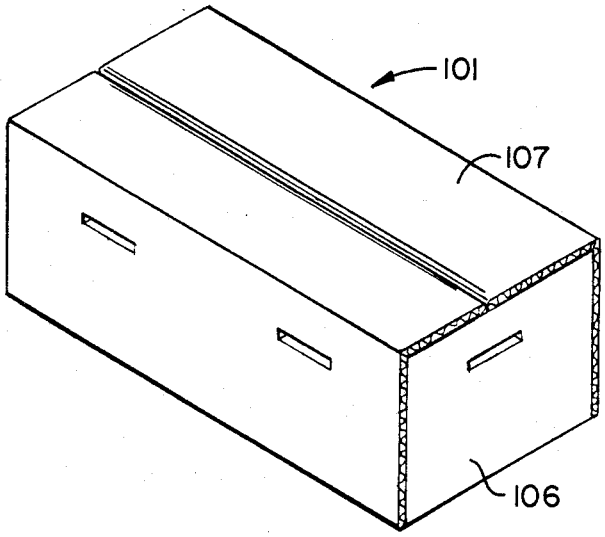
FIG. 10 is a perspective view of the block of FIG. 9 and inverted from normal orientation for use.
Figure 13:
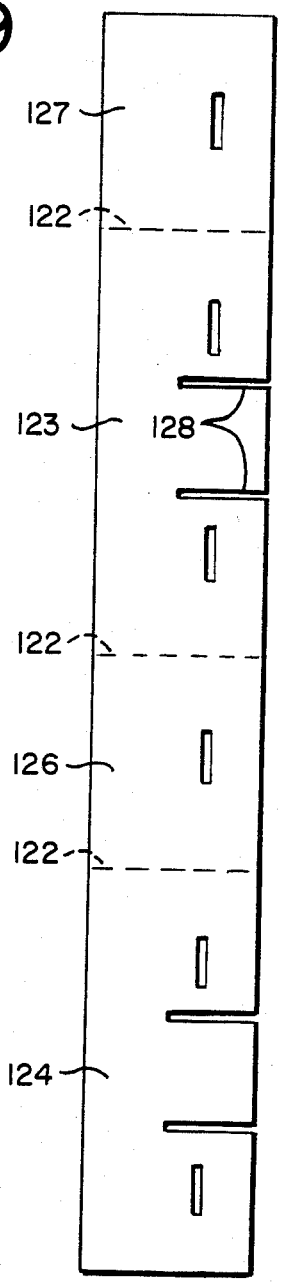
FIG. 13 is a plan view of a sheet adapted to be folded to form a part of an inner egg crate core structure of a block in accordance herewith.
Figure 14:
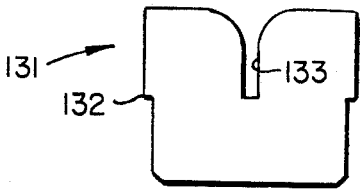
FIG. 14 is a plan view of one crosspiece for the core of FIG. 13.
Figure 15:
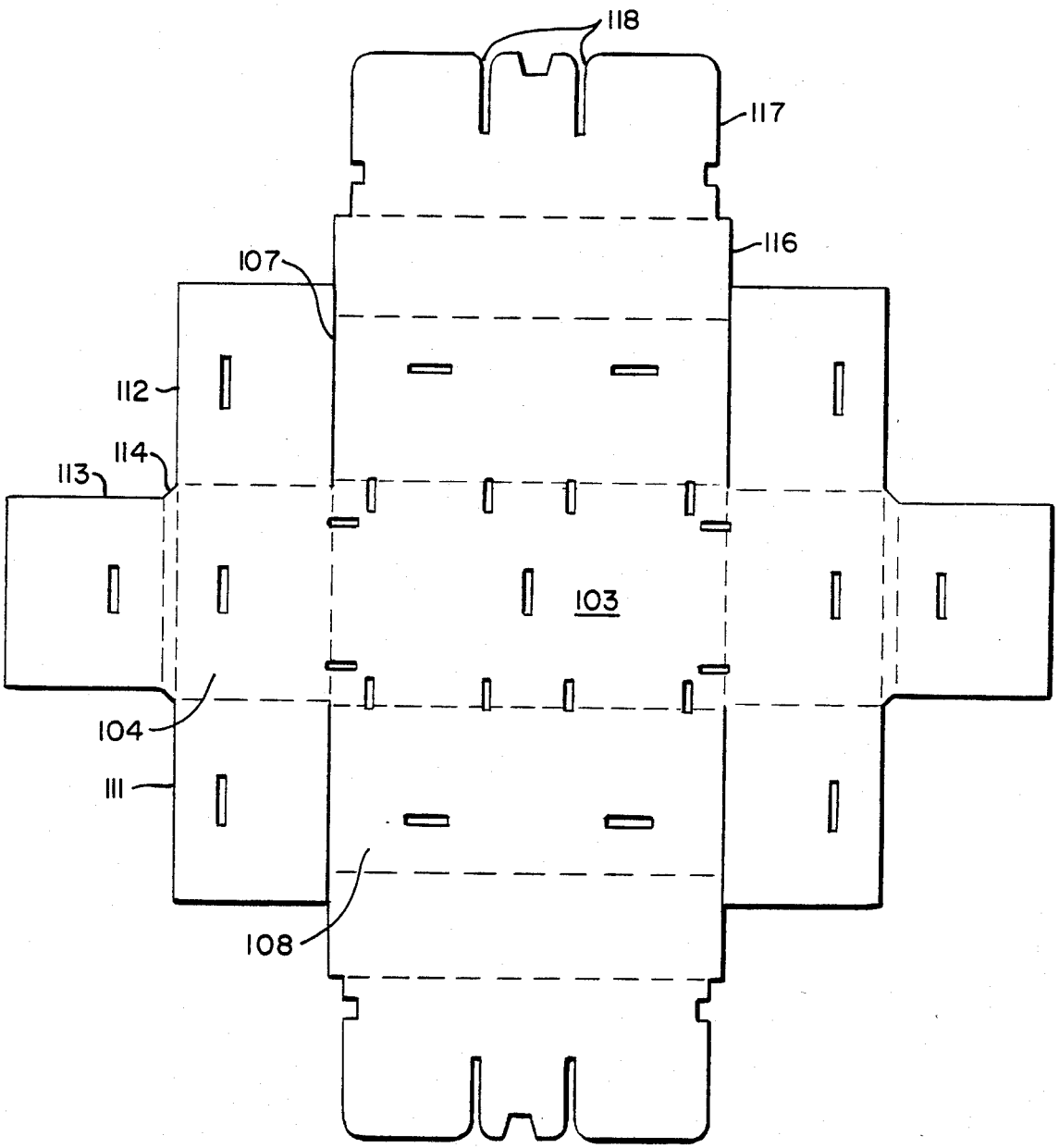
FIG. 15 is a plan view of a configured sheet from which a block may be folded along the dashed fold lines thereof.

The block 101 of FIGS. 9 and 10 is formed of an exterior sheet 102 of corrugated cardboard or the like including a top panel 103, end panels 104 and 106, and front and back panels 107 and 108, respectively, adapted to be folded along the dashed lines of FIGS. 13–15 into a rectangular block 101. Each end is similarly formed and considering the end wall 104, same will be seen to have side tabs 111 and 112, of the same height as the end wall 104, and an end tab 113 spaced from the wall 104 by a fold strip 114. Similarly, the front and back are formed alike with the front 107, for example, having a bottom half panel 116 extending therefrom and a central wall panel 117 extending from the bottom half panel 116 with spaced vertical slots 118 therein for accommodating interior reinforcing walls. The above-noted slots 118 preferably have outwardly flared ends, as shown, to facilitate folding of the central wall, as described below.

In addition to the exterior sheet 102 there are also provided interior elements including the elongated strip or sheet 121 of FIG. 13 having transverse fold lines 122 dividing the sheet into front and back portions 123 and 124, and end portions 126 and 127. This sheet 121 is adapted to be folded, as indicated in FIG. 9, to form a rectangle of dimensions to snuggly fit into the folded walls of block 101 with the end tabs 111 and 112 folded inwardly. These front and back portions 123 and 124 of the sheet 121 have spaced slots 128 formed therein from on edge to receive cross walls 131, illustrated in FIGS. 9 and 14. Each of these walls 131 have a generally rectangular shape with sides tabs or projections 132 along the upper part of each edge for fitting into the slots 128 of the inner sheet 121. The walls 131 each have a central vertical slot 133 extending therein from the top as drawn in FIG. 9 with outwardly flared ends and curved bottoms corners.

It is noted that the block 101 is shown in FIGS. 9 and 10 upside down from normal position of use, however, reference is made to the position of FIG. 9 for folding and assembly. Assembly of the block includes folding of the inner sheet 121 into a rectangle and placing same on the top panel 103 of the sheet 102. The end walls 104 and 106 are then folded upwardly agaist the ends 126 and 127 and the tabs 113 folded over these ends. The crosswalls 131 are inserted by sliding the tabs 132 thereof into the slots 128 of the inner strip 121 and the side tabs 111 and 112 of the ends 104 and 106 are folded against the front and back 123 and 124 of the inner portion. The front 107 and back 108 of the outer sheet 102 are folded up and the central walls 117 are folded down into the block with the slots 118 fitting into the slots 133 in the cross walls 131. The flared ends of the mating slots accommodate this folding and the completely assembled block appears as shown in FIG. 10, wherein the bottom panels 117 are held in place by the interlocking central walls 117 and cross walls 131. It is noted that the assembled interior of the block, including cross walls and central walls, comprises an egg crate reinforcement providing substantial structural strength to the block. The folded block will be seen to have the same thickness of walls for all sides and ends and this is necessary to accommodate the use of the same U-shaped connector for all connections, including corners. In the embodiment described immediately above there are provided three thicknesses of corrugated cardboard for each of the walls, however, alternative folding arraingments are possible to provide some other wall thickness as long as all walls have the same thickness.

The block structure described immediately above includes the openings in top edges and ends as previously described and shown in FIGS. 13 and 15, and the connectors of the invention cooperate therewith in the described manner. It is also noted that dimensions of panels and the like are relative to provide a snug fit of folded portions and appropriate cut outs are provided, as in the center of the central walls, to accommodate connectors and folding operations.

It will be seen from the foregoing description of elements of the present invention that the present systems provides for the construction of walls or the like as may be desired by children playing with the system to form forts, buildings or whatever. Half blocks may be provided as indicated, for example, at 57 of FIG. 3, to form an even end of a wall. Additionally, the present invention may be employed to form a right angle wall or corner as indicated in FIG. 4 and to this end at least certain blocks, as indicated for example, at **12*a* of FIG. 1 are also provided with top side edge openings 52 spaced apart the same distance as end opening 51 so that the end of one block may be butted to the side of another block in alignment with the end of the block and connectors 41 employed to join together these blocks. Similarly, corner blocks are provided with front and back slots 67 like the end slot 66 so that the T-shaped connector 61 or 81 may be also employed at corners to join successive row or courses at the corners. It is also noted that in the lower row or course of a wall the T-shaped connector 61 may be inverted for insertion of the top plate 62 thereof in end slots 66 of adjacent blocks with the depending plate 63 then extending upwardly between adjacent blocks to prevent twisting of adjacent blocks and to space the blocks apart in the bottom row of blocks. This arraingment is not appropriate with the connector 81 of FIG. 11**.

The present invention may also incorporate longer blocks general termed "spanner blocks" having a length, for example, of three normal blocks in order to extend over openings such as doorways or windows in a structure to be formed with the elements of the present invention. These spanner blocks are formed in the same manner as the blocks described above and are connected by the same connectors through like openings provided in the spanner blocks. It is also noted that blocks hereof may be also formed of a corrugated plastic such as polypropylene for use of the system outdoor where rain or the like might damage cardboard.

It will be seen from a consideration of system of the present invention that the blocks thereof when joined together are fully restrained from any type of movement relative to other blocks of the structure. By employing one or two U-shaped connectors 41 at each end of adjacent blocks the present system prevents any possible rotation of one block relative to the other and the length and width of the T-shaped connector also prevents any type of tilting or movement of one block relative to another. Although it is possible to form the block of the present invention in different sizes one convenient size is a block having a length of about 9" with a height and depth in the order of 4¼". This size is convenient for handling by children who then may readily construct enclosures such as rooms or the like in which they can play. Roof panels may be also provided if desired.

The present invention has been described above with respect to particular preferred embodiment thereof, however, it will be apparent to those skilled in the art that modifications and variations may be made within the scope of the present invention and thus it is not intended to limit the invention to the precise details of illustration or terms of description.

What is claimed is:

1. A building block system comprising:

A plurality of hollow block formed of rigid material, each of said blocks having at least one openings in the top thereof at each of the ends of the block and further openings including a transverse slot in the center of the top of a block and a transverse slot in each end of the block, and block connectors including a first inverted U-shaped connector adapted to fit into the said top end openings to join contiguous horizontally aligned blocks and a T-shaped connector adapted to fit into end slots of adjacent blocks and into a top slot of a lower block to connect successive courses of blocks.

2. The system of claim 1 further defined by said U-shaped connector having a top cross piece with legs depending from the ends of said cross piece and laterally rounded feet extending outward on the ends of each of said legs.

3. The system of claim 1 further defined by said block having openings in the top of the front and back thereof, aligned with said top transverse slot, and locking means adapted for insertion in said block through one of said front and back openings for engaging a T-shaped connector to retain same in connected position.

4. The system of claim 1 further defined by said U-shaped connector having a central depending spacer for separating adjacent blocks a small distance equal to the thickness of a depending portion of said T-shaped connector.

5. The system of claim 1 further defined by said T-shaped connector having aligned horizontal grooves on opposite sides of a depending portion thereof, and locking means having resiliently separable portions defining an expandable slot for engaging said T-shaped connector at said grooves to removably retain said T-shaped connector in engagement with the top of a block.

6. The system of claim 1 further defined by said T-shaped connector having a laterally extending flange along the bottom of a depending portion thereof for insertion in a top slot of a block with said flange bearing on the underside of the top of a block.

7. The system of claim 1 further defined by said block having openings in the top thereof along front and back of the block for attachment of a block at right angles to another block with said inverted U-shaped connectors.

8. The system of claim 1 further defined by each of said blocks having a folded egg crate reinforcement interiorly of the block with end portions of the block having tabs folded over portions of said reinforcement.

9. The system of claim 8 further defined by said reinforcement having cross walls with vertical slots in the center of each of said walls with said slots having outwardly flared ends and said block having folded panels with slots therein having flared ends for fitting into said cross walls as a central wall of said egg crate reinforcement.

* * * * *